US008668019B2

(12) United States Patent
Casciaro

(10) Patent No.: US 8,668,019 B2
(45) Date of Patent: Mar. 11, 2014

(54) DISSOLVABLE BARRIER FOR DOWNHOLE USE AND METHOD THEREOF

(75) Inventor: Dario Casciaro, Pescara (IT)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/981,083

(22) Filed: Dec. 29, 2010

(65) Prior Publication Data

US 2012/0168152 A1 Jul. 5, 2012

(51) Int. Cl.
*E21B 33/12* (2006.01)

(52) U.S. Cl.
USPC ..... 166/376; 166/292; 166/317; 166/387

(58) Field of Classification Search
USPC ..... 166/376, 387, 317, 386, 292
See application file for complete search history.

(56) References Cited

U.S. PATENT DOCUMENTS

| | | | | | |
|---|---|---|---|---|---|
| 2,638,167 | A * | 5/1953 | Jones | 137/67 |
| 3,361,203 | A * | 1/1968 | Rensvold | 166/376 |
| 4,050,517 | A * | 9/1977 | Matthews | 166/387 |
| 4,332,297 | A * | 6/1982 | Sandiford | 166/270 |
| 4,374,543 | A * | 2/1983 | Richardson | 166/192 |
| 4,464,994 | A * | 8/1984 | Porter | 102/333 |
| 4,579,175 | A * | 4/1986 | Grodde et al. | 166/295 |
| 4,988,238 | A * | 1/1991 | Szekely et al. | 405/263 |
| 5,417,285 | A * | 5/1995 | Van Buskirk et al. | 166/292 |
| 5,607,017 | A * | 3/1997 | Owens et al. | 166/288 |
| 5,623,993 | A * | 4/1997 | Van Buskirk et al. | 166/292 |
| 5,685,372 | A * | 11/1997 | Gano | 166/292 |
| 5,765,641 | A * | 6/1998 | Shy et al. | 166/292 |
| 5,826,661 | A * | 10/1998 | Parker et al. | 166/386 |
| 6,026,903 | A * | 2/2000 | Shy et al. | 166/292 |
| 6,076,600 | A * | 6/2000 | Vick et al. | 166/192 |
| 6,161,622 | A * | 12/2000 | Robb et al. | 166/386 |
| 6,220,350 | B1 * | 4/2001 | Brothers et al. | 166/192 |
| 6,367,549 | B1 * | 4/2002 | Chatterji et al. | 166/292 |
| 6,554,068 | B1 * | 4/2003 | Chatterji et al. | 166/285 |
| 6,561,275 | B2 * | 5/2003 | Glass et al. | 166/317 |
| 7,021,389 | B2 * | 4/2006 | Bishop et al. | 166/373 |
| 7,150,326 | B2 * | 12/2006 | Bishop et al. | 166/373 |
| 7,322,417 | B2 * | 1/2008 | Rytlewski et al. | 166/313 |
| 7,350,582 | B2 * | 4/2008 | McKeachnie et al. | 166/373 |
| 7,493,956 | B2 * | 2/2009 | Shaw et al. | 166/292 |
| 7,690,436 | B2 * | 4/2010 | Turley et al. | 166/387 |
| 7,712,521 | B2 * | 5/2010 | Sorensen | 166/179 |
| 7,775,285 | B2 * | 8/2010 | Surjaatmadja et al. | 166/374 |
| 7,775,286 | B2 * | 8/2010 | Duphorne | 166/376 |
| 7,798,236 | B2 * | 9/2010 | McKeachnie et al. | 166/376 |

(Continued)

OTHER PUBLICATIONS

Oyler, "Use of a Sodium Silicate Gel Grout for Pluggin Horizontal Methane-Drainage Hole," 1984, U.S. Department of Interior, Bureau of Mines, Report of Investigations 8843.*

(Continued)

*Primary Examiner* — Jennifer H Gay
(74) *Attorney, Agent, or Firm* — Cantor Colburn LLP

(57) ABSTRACT

A plug is disposable in a well bore to block fluid from passing through the wellbore. The plug includes a body formed from water soluble glass. The body is dissolvable in water. A method of utilizing water soluble glass includes employing an element formed of the water soluble glass, performing a first function in the system when the element is present, dissolving the element in the presence of water, and performing a second function in the system different than the first function.

17 Claims, 6 Drawing Sheets

(56) References Cited

U.S. PATENT DOCUMENTS

| | | | | |
|---|---|---|---|---|
| 7,806,189 | B2 * | 10/2010 | Frazier | 166/376 |
| 8,056,628 | B2 * | 11/2011 | Whitsitt et al. | 166/278 |
| 8,056,643 | B2 * | 11/2011 | Basmajian et al. | 166/386 |
| 8,061,388 | B1 * | 11/2011 | O'Brien et al. | 138/89 |
| 2005/0205264 | A1 * | 9/2005 | Starr et al. | 166/376 |
| 2005/0241828 | A1 * | 11/2005 | Almond et al. | 166/292 |
| 2006/0131031 | A1 * | 6/2006 | McKeachnie et al. | 166/376 |
| 2007/0017675 | A1 * | 1/2007 | Hammami et al. | 166/278 |
| 2007/0044958 | A1 * | 3/2007 | Rytlewski et al. | 166/250.01 |
| 2007/0051521 | A1 * | 3/2007 | Fike et al. | 166/387 |
| 2007/0074873 | A1 * | 4/2007 | McKeachnie et al. | 166/376 |
| 2007/0107908 | A1 * | 5/2007 | Vaidya et al. | 166/376 |
| 2007/0215352 | A1 * | 9/2007 | Shaw et al. | 166/292 |
| 2007/0221384 | A1 * | 9/2007 | Murray | 166/376 |
| 2008/0115932 | A1 * | 5/2008 | Cooke, Jr. | 166/250.01 |
| 2008/0128130 | A1 * | 6/2008 | Whitsitt et al. | 166/278 |
| 2008/0149345 | A1 * | 6/2008 | Marya et al. | 166/376 |
| 2008/0149351 | A1 * | 6/2008 | Marya et al. | 166/387 |
| 2008/0156489 | A1 * | 7/2008 | Pershikova et al. | 166/280.1 |
| 2008/0199351 | A1 | 8/2008 | Woodbridge | |
| 2008/0251253 | A1 * | 10/2008 | Lumbye | 166/285 |
| 2008/0271898 | A1 * | 11/2008 | Turley et al. | 166/382 |
| 2009/0084539 | A1 * | 4/2009 | Duan et al. | 166/187 |
| 2009/0101334 | A1 * | 4/2009 | Baser et al. | 166/193 |
| 2009/0255674 | A1 * | 10/2009 | Boney et al. | 166/284 |
| 2009/0255686 | A1 * | 10/2009 | Richard et al. | 166/376 |
| 2010/0212891 | A1 | 8/2010 | Stewart et al. | |
| 2010/0252273 | A1 * | 10/2010 | Duphorne | 166/376 |
| 2010/0294510 | A1 * | 11/2010 | Holmes | 166/376 |
| 2011/0042088 | A1 * | 2/2011 | Gassemzadeh et al. | 166/292 |
| 2011/0284232 | A1 * | 11/2011 | Huang | 166/317 |
| 2011/0308802 | A1 * | 12/2011 | Ladva et al. | 166/305.1 |
| 2011/0311719 | A1 | 12/2011 | Bicerano | |
| 2011/0315381 | A1 * | 12/2011 | Streetman | 166/292 |
| 2012/0012315 | A1 * | 1/2012 | Woytowich et al. | 166/285 |
| 2012/0168152 | A1 * | 7/2012 | Casciaro | 166/250.03 |
| 2012/0181034 | A1 * | 7/2012 | Bour et al. | 166/310 |

OTHER PUBLICATIONS

"Sodium Silicate", http://www.thefreedictionary.com/sodium+silicate, retrieved from internet Feb. 26, 2013.*

Halliburton, "Mirage Disappearing Plug and Autofill Sub", Completion Solutions, www.hallliburton.com, H00093, Jun. 2010, pp. 1-2.

International Search Report and Written Opinion, Date of Mailing Aug. 30, 2012, International application No. PCT/US2011/065839, Korean Intellectual Property Office, International Search Report 5 pages, Writtion Opinion 5 pages.

* cited by examiner

DISSOLVABLE BARRIER FOR DOWNHOLE USE AND METHOD THEREOF

BACKGROUND

While drilling and producing wells for the recovery of petroleum and other subsurface deposits, it is often necessary to close off or plug a tubular conduit, such as a string of tubing extending from the well surface to a subterranean location, at a chosen point along the length of the conduit. Subsequently, it is necessary to be able to re-open the conduit for flow therethrough. A plug used to close off the tubing during setting of a well tool, such as a packer, may then be released so that fluid may be circulated through the tubing.

Certain types of plugs are designed to be permanently installed, and they must be drilled or milled to be removed, which can be labor intensive. Other types of plugs are designed to be retrieved when the purpose for which the plug has been installed has been accomplished. Retrievable plugs generally employ some form of releasable anchoring device by which the plug may be secured to the internal bore of the well pipe and which may then be released to enable the plug to be withdrawn. One disadvantage of this prior art arrangement is that a restriction in the internal diameter of the tubing string often accompanies the design. Also, the prior art plugs were often retrieved on a wireline and the retrieval operation was complicated in the case of deviated well bores. Debris that sometimes accumulates on the top of the retrievable plug can also cause issues in the wellbore.

Another prior art plug design involves the incorporation of a plug of expendable material and an actuating device used to dislocate or fracture the plug upon receipt of a triggering signal. The potential for remaining and problematic debris from the plug in the tubing string or wellbore must be carefully monitored in such devices. Sand plugs, for instance, have been provided for zonal isolation within wellbores, however the integrity of such sand plugs can be inconsistent and remaining particulates must be dealt with.

BRIEF DESCRIPTION

A plug disposable in a well bore to block fluid from passing through the wellbore, the plug includes a body formed from water soluble glass, the body dissolvable in water.

An apparatus which controls flow of well bore fluids from a production zone located within a subterranean formation adjacent the well bore to a well surface, the apparatus includes a tubular housing extending from the well surface to a selected depth within the well bore, the tubular housing having an internal bore for passage of fluids; and, a plug including a body formed from water soluble glass, the body dissolvable in water, the plug positioned within the tubular housing to initially close off the internal bore of the housing.

A method of utilizing water soluble glass in a downhole fluid conducting system, the method includes employing an element formed of water soluble glass; performing a first function in the system when the element is present; dissolving the element in the presence of water; and performing a second function in the system different than the first function.

A system which detects presence of formation water in an underground location, the system includes a casing insertable within a wellbore; a chemical sensor within the casing; and a first water detection body including a first detectable chemical element surrounded by water soluble glass, wherein the first water detection body is locatable within a fractured formation and the chemical sensor senses the first detectable chemical element when formation water dissolves the water soluble glass

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
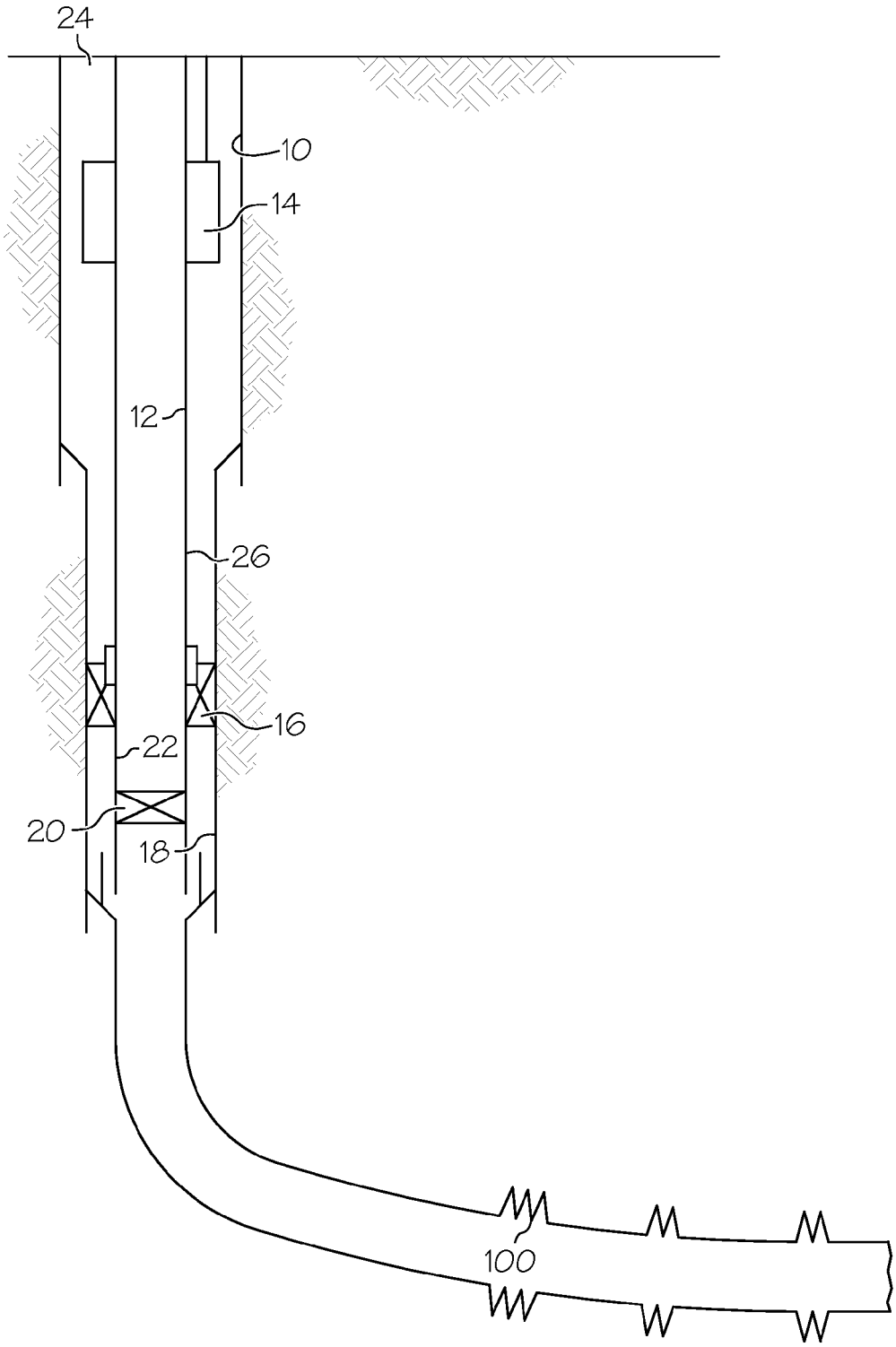
FIG. 1 depicts a schematic view of a well bore completion showing an exemplary embodiment of a dissolvable plug.
Figure 2:
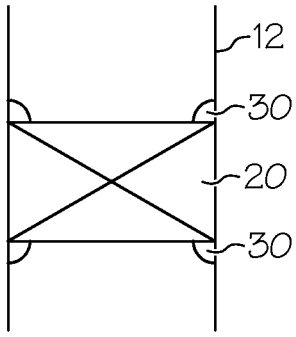
FIG. 2 depicts a cross sectional view of an exemplary embodiment of the dissolvable plug of FIG. 1.

Referring to FIG. 1, a wellbore 10 is shown lined with a casing 12, also known as a tubular, tubular housing, string, etc. A tubing mounted valve 14 may be located within the string of casing 12. A packer 16 isolates an annular region 18 between the casing 12 and the wellbore 10. According to exemplary embodiments of the present invention, a dissolvable plug 20 initially closes off flow from a perforated zone 100 up the internal bore 22 of the casing 12 to the well surface 24. The dissolvable plug 20 forms a portion of the well tool 26, and may, in one exemplary embodiment, have an outer diameter which is approximately equal to an internal diameter of the casing 12 forming the flow path to the well surface 24 where the plug 20 is seated. Thus, the plug 20 advantageously need not require any significant constructions or devices that restricts an internal diameter of the internal bore 22 of the casing 12, however, as shown in FIG. 2, a small seat 30 such as seating device or shoulder or other protrusion may be provided to ensure that the plug 20 does not slide out of place. In an exemplary embodiment, the seating device 30 may be made from the same dissolvable material as the plug 20.

Figure 3:
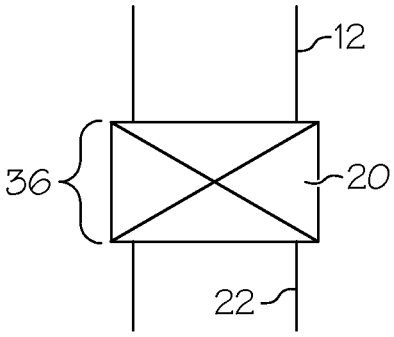
FIG. 3 depicts a cross sectional view of another exemplary embodiment of the dissolvable plug of FIG. 1.

In an alternative exemplary embodiment shown in FIG. 3, in lieu of seating device 30, the casing 12 may include a section 36 have an internal diameter in an area for receiving the plug 20 that is larger than an internal diameter of a remainder of the internal bore 22 of the casing 12. In this case, the plug 20 may be formed with the casing 12 prior to positioning the tubing in the wellbore 10.

The plug 20 may be formed and pre stressed within a section of the tubing string or casing 12 to provide sufficient strength against pressure within the tubing. In an alternative exemplary embodiment, the plug 20 may first be formed as a separate element and then secured within the casing 12 using an adhesive component such as, but not limited to, the same dissolvable material as the plug 20.

In these exemplary embodiments, the plug 20 is made of water soluble glass, which is made from silica and soda. Soda reduces the melting point of silica, which makes it easier to create glass, and soda also renders the glass water soluble. The most prevalent type of glass is soda-lime glass, also called soda-lime-silica glass, where the lime is added to restore insolubility. In one exemplary embodiment of the plug 20, made from soda and silica and without lime, the water soluble glass plug 20 will dissolve when in contact with water or steam. Some samples have been shown to dissolve at a rate of about 0.0001" per minute at about 180° F., however the solubility rate is temperature sensitive to the water that it is dissolved in, and salt water has been shown to dissolve the water soluble glass at a slower rate. In a non aqueous environment, the material remains intact at high temperatures, such as about 1500° F. to about 2000° F. As another important feature, the plug 20 is insoluble to oil and petroleum based liquids and this feature may be advantageously employed in the present invention.

In one exemplary embodiment, the plug 20 is formed using water soluble glass with dimensions and content suitable for its intended applications. By varying and balancing both the thickness of the plug and the content of soda in the glass matrix, the solubility can be modulated. For example, the thickness and soda content of a plug 20 can be adjusted such that a wellbore tool 26, such as a packer, remains plugged until the required operation is carried out.

While the plug 20 may be installed in the casing 12 using conventional methods, the removal of the plug 20 may be determined based on intended use. In one exemplary embodiment, the plug 20 is installed in the wellbore tool 26 in a conventional manner and may be allowed to begin dissolving while the operation is being carried out, so long as the plug 20 is not completely dissolved until after the operation is completed. In another exemplary embodiment, the thickness of the plug 20 may be sufficiently thick and the soda content sufficiently low such that the plug 20 barely dissolves even in the presence of water to guarantee that a required operation is completed before dissolution.

Figure 4:
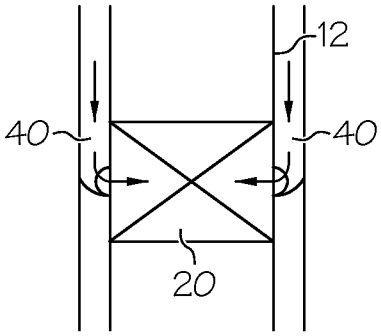
FIG. 4 depicts a cross-sectional view of an exemplary embodiment of a dissolution advancement system.

In an exemplary embodiment shown in FIG. 4, to advance the dissolution of the plug 20, at least one fluid port 40, or a plurality of fluid ports 40 may be provided in an area circumferentially surrounding the plug 20. Water or heated water may be provided to the plug 20 at a time when the plug 20 is to be dissolved. The temperature of the water and the time the plug 20 is exposed to the water may both be selected to dissolve the plug 20 in a desired amount of time. The fluid ports 40 may be arranged such that the water or heated water is directed towards a portion of the plug 20 that is desired to be dissolved first.

Figure 5A:
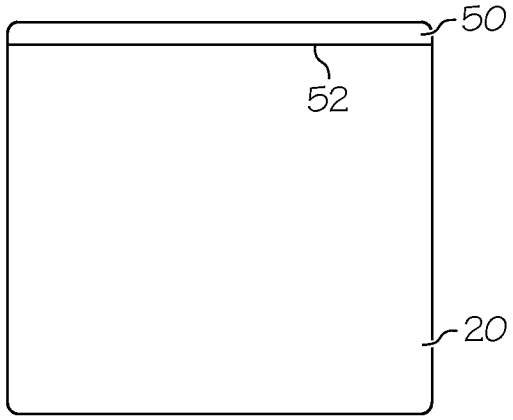
FIGS. 5A-5C depict various embodiments of a protective oil-based layer on the dissolvable plug of FIG. 1.
Figure 5B:
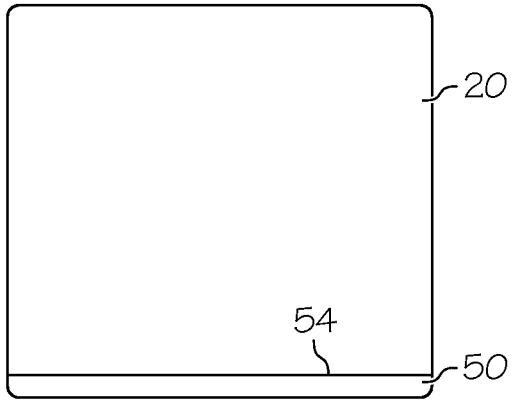
Figure 5C:
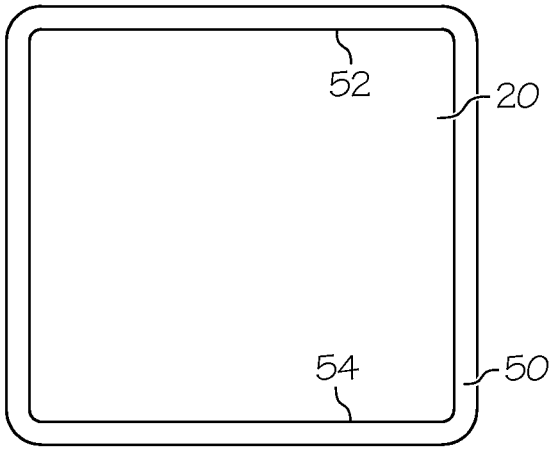

In yet another exemplary embodiment, as shown in FIGS. 5A-5C, the plug 20 includes a protective oil-based layer 50 deployed on at least one surface of the plug 20 to prevent the plug 20 from coming into contact with water, thereby retaining its initial structure until the layer 50 is removed and water is introduced to the plug 20. In an exemplary embodiment shown in FIG. 5A, the layer 50 is deployed on an upper surface 52 of the plug 20, such as a surface facing an uphole direction of the wellbore 10. In another exemplary embodiment shown in FIG. 5B, the lower surface 54 of the plug 20 includes a protective oil-based layer 50, such as a surface facing a downhole direction of the wellbore 10, and in yet another exemplary embodiment shown in FIG. 5C, at least both the upper and lower surfaces 52, 54 of the plug 20 include a protective oil-based layer 50, such as all surfaces of the plug 20.

Figure 6:
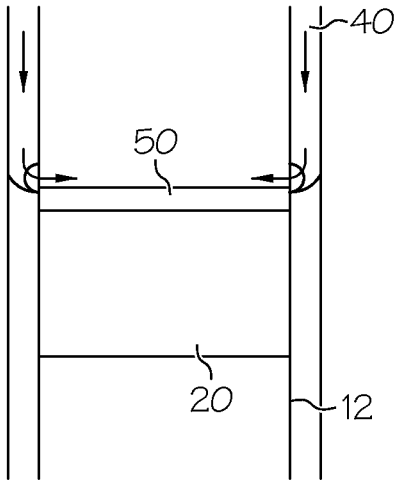
FIG. 6 depicts a schematic view of an exemplary embodiment of a chemical employing system for removing the protective oil-based layer of FIGS. 5A-5C.

Removal of the oil-based layer 50 may be accomplished using a mechanical device and/or chemical means. To chemically remove the oil-based layer 50, surfactants, such as emulsifiers, detergents, etc., may be used to break the bonds holding the molecules of the oil together so that the oil molecules can be separated and rinsed away. As shown in FIG. 6, the chemical introduction may occur using fluid ports 40 that direct the oil removing chemical substance towards the oil-based layer 50. These may be the same ports 40 that direct water or heated water to the plug 20 for dissolution of the plug 20. The fluid ports 40 may also be used to vacuum the oil removing chemical substance and oil-based layer 50 away from the plug 20. While certain chemical removal embodiments are described, other devices to chemically remove the layer from the plug would be within the scope of these embodiments.

Figure 7:
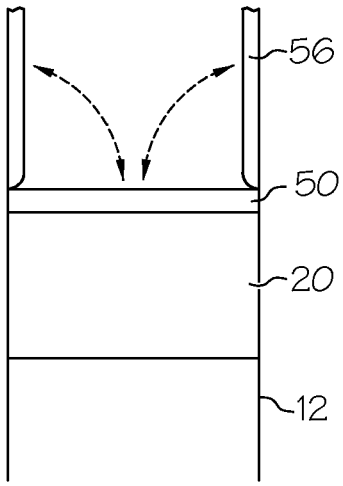
FIG. 7 depicts a schematic view of an exemplary embodiment of a mechanical device for removing the protective oil-based layer of FIGS. 5A-5C.

As shown in FIG. 7, to mechanically remove the oil based layer 50 from the plug 20, a mechanical device 56 may extend from the casing 12, such as a scraper or brush which may be used to at least partially remove the protective layer. The scraper or brush may be a single blade used to wipe off the oil, matter used to absorb the oil, a series of bristles, etc. The mechanical device 56 may be actuated using known downhole tool actuators and may rotate along an interior of the casing 12 to wipe off the layer 56. The mechanical device may also includes elements made of water soluble material, such as water soluble glass, such that it can also be dissolved in the presence of water. While certain mechanical removal embodiments are described, other devices to mechanically remove the layer from the plug would be within the scope of these embodiments.

Although the plug 20 has been described as being removed by dissolving with water, in yet another exemplary embodiment, the plug may be removed by first breaking the glass structure of the plug 20. Breaking the glass structure of the plug 20 may be accomplished by using any known fracturing technique. By fracturing the plug 20 and introducing water to interior surfaces of the plug 20, the plug 20 will quickly dissolve and be absorbed by the wellbore fluid.

The exemplary embodiments disclosed thus far have provided a glass water soluble plug 20 for use in plugging a tool 26 until removal of the plug 20 is warranted. Alternative exemplary embodiments of designs and methods for employing the water soluble glass material within the wellbore 10 will now be described.

Figure 8:
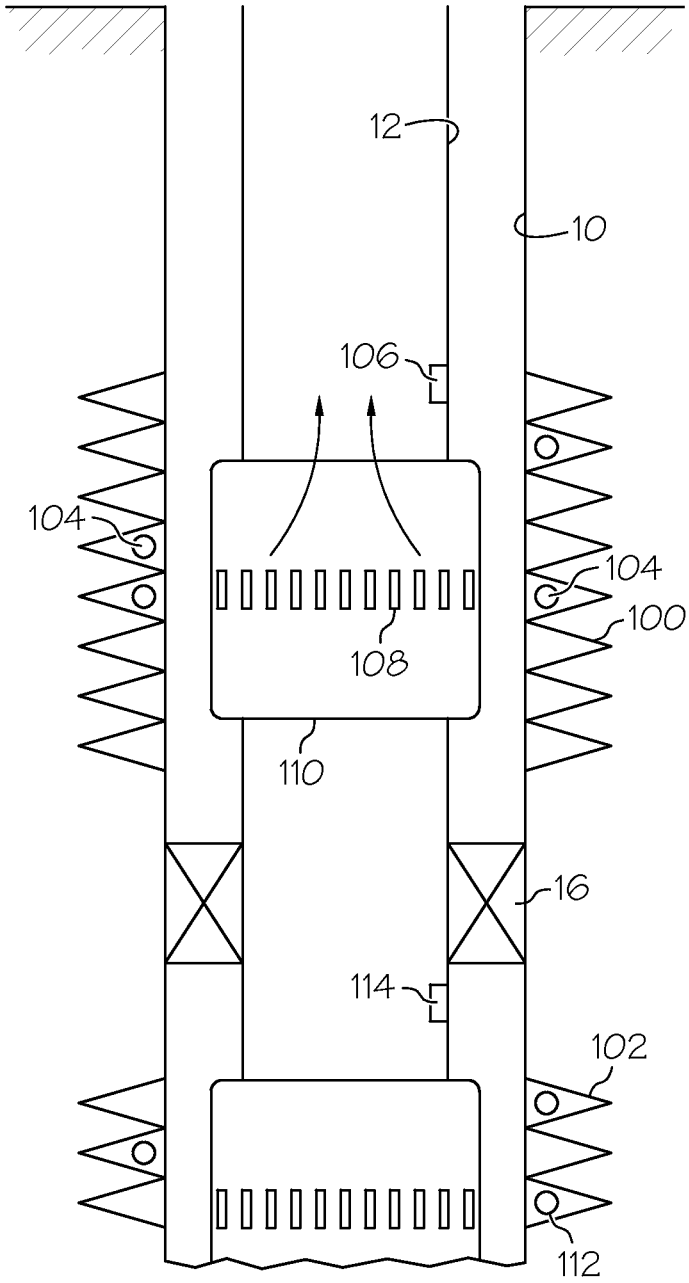
FIG. 8 depicts a schematic view of an exemplary embodiment of a system for detecting formation water.

In one exemplary embodiment for employing water soluble glass in a wellbore 10, as shown in FIG. 8, the water soluble glass is used as a carrier for long term curing chemicals, which are embedded in the glass matrix, for fracturing/stimulating operations. The glass body 104, when sent down the well bore 10 or into perforations 100 would be able to store chemicals underground and release them only when exposed to formation water. When the glass body 104 is dissolved by formation water, the chemicals are released and enter the casing 12 through openings 108 in tool 110 and they may then be sensed by a chemical sensor 106, which in turn may send a communication signal that indicates the presence of formation water, may actuate a downhole tool such as opening or closing a sleeve, or may increase a count on a counter.

Similar to the above-described exemplary embodiment, in another exemplary embodiment for employing water soluble glass in a wellbore 10, different detectable chemical elements are embedded in the glass matrix and glass bodies 112 including the different detectable chemical elements are pumped in multi-layered fractured formations. That is, a glass body or bodies 104 containing a first detectable chemical element may be pumped or otherwise directed into a first layer or perforation 100 of the well, while a glass body or bodies 112 containing a second detectable chemical element, different than the first detectable chemical element, is pumped into a second layer or perforation 102 of the well which is distanced from the first layer or perforation 100. First and second chemical sensors 106, 114 may be positioned within the casing 12 for detecting the existence of the corresponding chemicals, and may trigger the appropriate response as described above. While only two different detectable chemical elements and layers are described, it would be within the scope of these embodiments to include multiple different chemical elements for detecting formation water from any number of layers. Thus, it is possible to detect from what specific layer formation water is coming from depending on which chemical sensor is activated. While two chemical sensors have been described, it would also be within the scope of these embodiments to employ a single chemical sensor, which reacts differently, depending on which chemical is detected.

Figure 9:
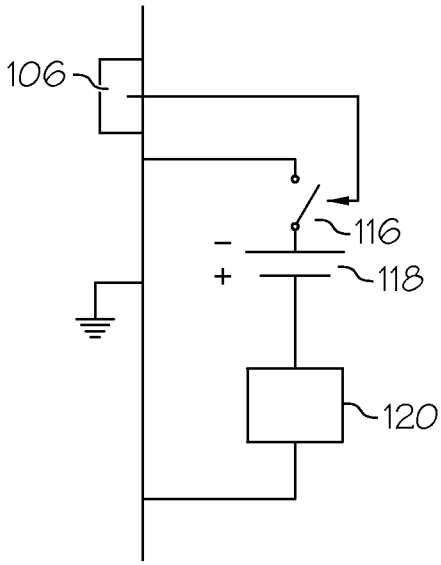
FIG. 9 depicts a circuit diagram for use with a chemical sensor within the exemplary system of FIG. 8; and, FIG. 10 depicts a circuit diagram of an exemplary embodiment of a closure device.

An exemplary embodiment of chemical sensor 106 is shown in FIG. 9. Sensor 106 is communicatively connected to and triggers switch 116 closing a circuit to battery 118 and powering actuation mechanism 120.

Figure 10:
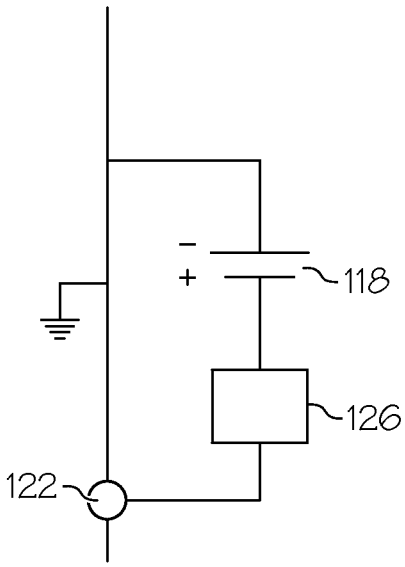

In yet another exemplary embodiment, the water soluble glass is used as an inexpensive override system to actuate a downhole tool. In one such exemplary embodiment, the water soluble glass may be used to shut down a non-deepset safety valve. In a condition where the chamber becomes flooded by water, replacing oil initially present, a passive dissolvable part made with the water soluble glass may then initiate a process that leads to the final closure of a flapper. The process may be completely mechanical, such as by the passive dissolvable part releasing a latch. Alternatively, as represented by FIG. 10, the dissolvable part 122 may include an electrode and when a water soluble glass covering of the part 122 is dissolved by water, the electrode is ground to the casing 12 or to the wellbore fluids and completes the circuit. Dissolving the encapsulated electrode completes the circuit and allows power to flow across the actuator mechanism 126 to actuate the downhole tool.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A downhole tool configured to control flow of fluids in a wellbore, the downhole tool including:

a tubular housing; and, a plug for the tubular housing, the plug configured to block fluid from passing through the wellbore in an initial condition of the plug, the plug comprising a water soluble glass body, the plug dissolvable in water and reconfigured to a second condition to unblock the tubular housing in a dissolved condition of the plug.

2. The downhole tool of claim 1, wherein the plug includes a protective oil-based layer coated on at least one surface of the water soluble glass body, wherein the layer is rinsable off the water soluble glass body when the plug is to be dissolved.

3. An apparatus which controls flow of well bore fluids from a production zone located within a subterranean formation adjacent a well bore to a well surface, the apparatus comprising:

a tubular housing extending from the well surface to a selected depth within the well bore, the tubular housing having an internal bore for passage of fluids; and, a plug including a water soluble glass body, the water soluble glass body dissolvable in water, the water soluble glass body having an outer diameter approximately equal to an internal diameter of the internal bore, the plug positioned within the tubular housing to initially close off the internal bore of the housing.

4. The apparatus of claim 3, wherein the plug includes a protective oil-based layer coated on at least one surface of the body, the layer removable by a surfactant.

5. The apparatus of claim 4, further comprising at least one fluid conduit having an exit positioned adjacent the plug, wherein the at least one fluid conduit delivers a surfactant to at least partially remove the oil-based layer.

6. The apparatus of claim 3, wherein the body of the plug is formed within the internal bore.

7. The apparatus of claim 6, wherein the tubular housing includes a section having an increased diameter as compared to a remainder of the internal bore, the plug formed within the section.

8. The apparatus of claim 3, wherein the body of the plug is adhered within the internal bore by a water soluble adhesive.

9. The apparatus of claim 8, wherein the water soluble adhesive is water soluble glass.

10. The apparatus of claim 3, further comprising at least one fluid conduit having an exit positioned adjacent the plug, wherein the at least one fluid conduit delivers water of a predetermined temperature to dissolve the plug at a predetermined rate.

11. A method of utilizing water soluble glass in a downhole fluid conduction system, the method comprising:

employing a water soluble glass element as a plug and using the water soluble glass element to plug the downhole fluid conduction system;

performing a first function in the system when the element is present including preventing passage of wellbore fluids through the system;

dissolving the water soluble glass element in the presence of water; and performing a second function in the system different than the first function including allowing the passage of wellbore fluids through the system.

12. The method of claim 11, wherein dissolving the element includes directing water of a predetermined temperature towards the element.

13. The method of claim 11, wherein the water soluble glass element is protected by an oil-based layer, and dissolving the water soluble glass element includes chemically removing the oil-based layer to expose the element to water.

14. The method of claim 13, wherein chemically removing the oil-based layer includes chemically breaking bonds between oil molecules of the oil-based layer.

15. The method of claim 13, wherein chemically removing the oil-based layer includes employing a surfactant to chemically remove the oil-based layer.

16. A plug disposable in a well bore to block fluid from passing through the wellbore, the plug comprising a body formed from water soluble glass, the body dissolvable in water, and a protective oil-based layer coated on at least one surface of the body, wherein the layer is rinsable off the body when the plug is to be dissolved and the layer includes molecules bonded together by bonds that are breakable by a chemical, the layer configured to be rinsed off the body when the molecules are separated from each other by the chemical.

17. An apparatus which controls flow of well bore fluids from a production zone located within a subterranean formation adjacent a well bore to a well surface, the apparatus comprising:

a tubular housing having an internal bore for passage of fluids;

a plug including a body formed from water soluble glass, the body dissolvable in water, the plug positioned within the tubular housing to initially close off the internal bore of the housing, the plug further including a protective oil-based layer coated on at least one surface of the body; and, at least one fluid conduit having an exit positioned adjacent the plug, wherein the at least one fluid conduit delivers a chemical to at least partially remove the oil-based layer, wherein the layer includes molecules bonded together by bonds that are breakable by the chemical, the layer rinsed off the body when the molecules are separated from each other by the chemical delivered by the at least one fluid conduit.

* * * * *